US005435462A

United States Patent [19]

Fujii

[11] Patent Number: 5,435,462

[45] Date of Patent: Jul. 25, 1995

[54] LIQUID CARTRIDGE STORAGE CASE FOR USE WITH LIQUID DIPENSER

[75] Inventor: Hideyo Fujii, Tokyo, Japan

[73] Assignee: Nordson Corporation, Westlake, Ohio

[21] Appl. No.: 181,845

[22] Filed: Jan. 14, 1994

[30] Foreign Application Priority Data

Jan. 20, 1993 [JP] Japan ..... 5-004326 U

[51] Int. Cl.[6] ..... B67D 5/00

[52] U.S. Cl. ..... 222/82; 222/83.5; 222/88; 222/91; 222/144.5; 222/145.7; 222/327; 222/389

[58] Field of Search ..... 222/81, 82, 83, 83.5, 222/88, 91, 144.5, 145, 325, 326, 327, 386, 389

[56] References Cited

U.S. PATENT DOCUMENTS

| | | | |
|---|---|---|---|
| 1,905,936 | 4/1933 | Heard | 222/494 |
| 2,459,807 | 1/1949 | Gavin et al. . | |
| 3,831,845 | 8/1974 | Pacht | 239/76 |
| 3,880,331 | 4/1975 | Perkins | 222/327 |
| 4,179,051 | 12/1979 | Thomas | 222/494 |
| 4,247,018 | 1/1981 | Credle | 222/144.5 X |
| 4,693,397 | 9/1987 | Lang | 222/327 X |
| 4,901,890 | 2/1990 | Mivelaz | 222/83.5 X |
| 5,074,443 | 12/1991 | Fujii et al. | 222/639 |

OTHER PUBLICATIONS

"Dispensing and Application Equipment for Adhesives and Sealants", James E. DeVries, Automotive Business Group, Nordson Corporation, 1991, pp. 693–702 (Reprint).

"Automation and Robotics for Adhesives and Sealants Use", Herb Turner, Automotive Business Group, Nordson Corporation, 1991, pp. 716–725 (Reprint).

*Primary Examiner*—Andres Kashnikow
*Assistant Examiner*—Joseph A. Kaufman
*Attorney, Agent, or Firm*—Wood, Herron & Evans

[57] ABSTRACT

A liquid cartridge storage case is used in connection with a plunger valve liquid dispenser to provide simplified and accurate control of liquid dispensing from a commercially available liquid cartridge, along with reduced downtime. The storage case includes a lower body section to which a commercially available liquid cartridge threadably mounts. Threading of the cartridge to the lower body section pierces a bottom membrane of the cartridge to allow liquid from the cartridge to flow into an internal passage in the lower body section. The internal passage communicates with a passageway of the dispenser through which liquid flow is controlled, via the plunger valve, for dispensing out of a nozzle at one end thereof. Pressurized air supplied from an external source to the inside of the case causes a cartridge wall opposite the pierced membrane to move toward the pierced membrane, thereby forcing liquid under pressure from the cartridge and into the dispenser. An additional liquid cartridge storage case may be connected to the liquid dispenser in parallel, thereby to allow dispensing from a liquid cartridge in one of the storage cases while the spent liquid cartridge of the other case is being replaced.

6 Claims, 1 Drawing Sheet

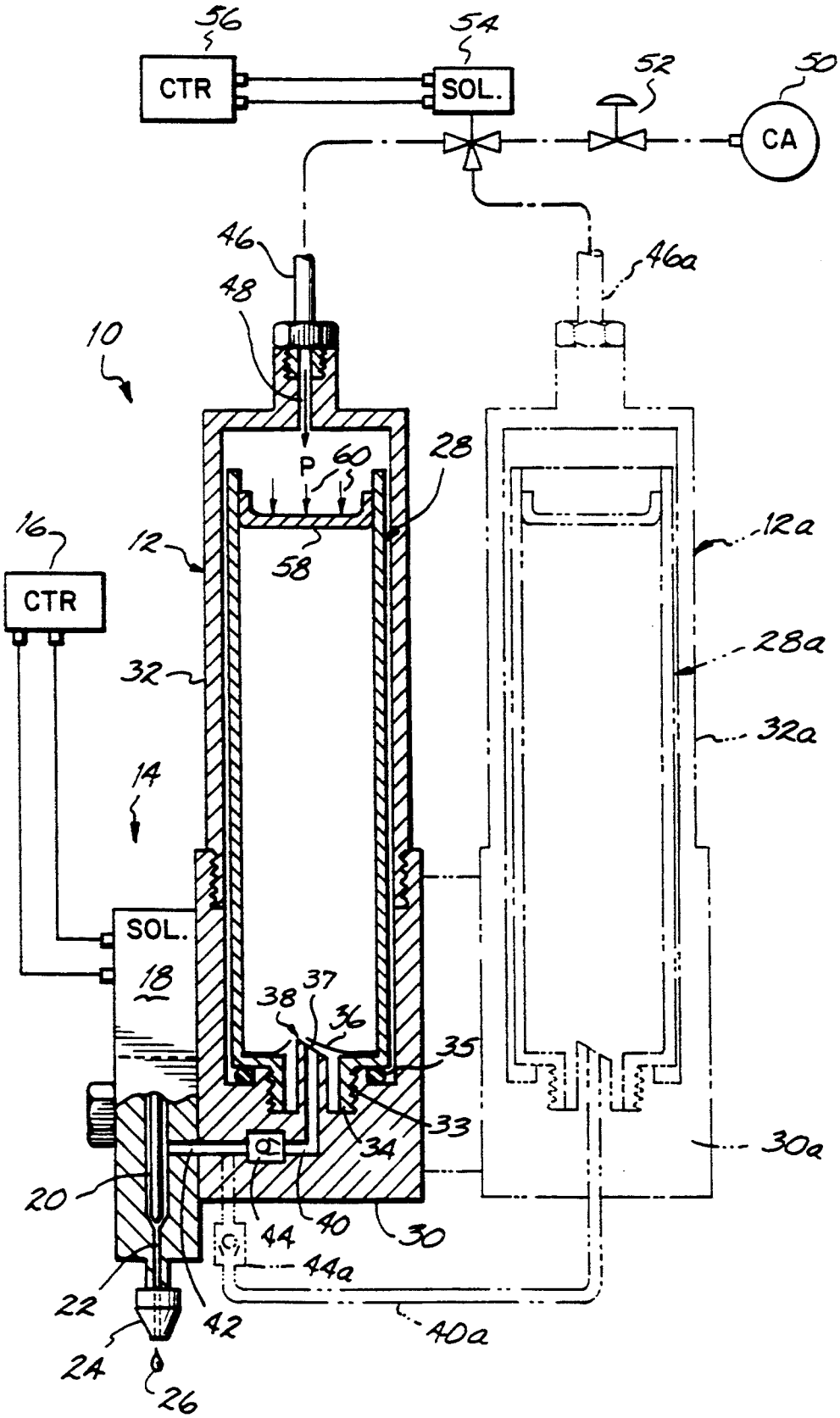
56
CTR
54
SOL.
52
50
CA
46
46a
48
10
P
60
28
16
CTR
12
58
12a
28a
32
32a
14
SOL.
18
38
37
36
35
33
34
30a
20
44
40
30
44a
22
42
40a
24
26

LIQUID CARTRIDGE STORAGE CASE FOR USE WITH LIQUID DIPENSER

FIELD OF THE INVENTION

This invention relates to a liquid dispensing apparatus for dispensing liquid from commercially available liquid cartridges.

BACKGROUND OF THE INVENTION

Many commercially available liquids for dispensing, such as adhesives, sealants, etc. are dispensed from commercially available liquid cartridges. Even liquids such as paints can be dispensed from such liquid cartridges. Usually dispensing from these liquid cartridges is manually controlled, as by a commercial handgun. However, in many dispensing operations, the manual control of the liquid dispensed from a liquid cartridge via a normally operated handgun is not accurate enough. Thus, while the wide commercial availability of various liquids in easy-to-use liquid cartridges facilitates economic liquid dispensing for multiple commercial applications, there exists a need for greater precision and accuracy in dispensing liquid from such cartridges. In addition, it is desirable to provide increased accuracy and control in a simple and economical manner, so that the ease of liquid cartridge use is not defeated by the manner of dispensing. Stated another way, it is desirable to achieve improved control of liquid dispensing from a commercially available liquid cartridge in a manner which is simple, practical and economical.

Because many applications for dispensing liquid from liquid cartridges require the use of multiple cartridges, it is also desirable to minimize downtime associated with replacing a spent cartridge with a new cartridge.

It is an object of this invention to increase the accuracy and control of liquid dispensing from a commercially available liquid cartridge without compromising practicability, simplicity and economy.

It is another object of the invention to improve control over liquid dispensing from a commercially available liquid cartridges while at the same time reducing downtime associated therewith.

SUMMARY OF THE INVENTION

The above-stated objectives are achieved by using a cylindrical cartridge storage case in combination with a plunger valve liquid dispensing gun to accurately dispense pressurized liquid. The cartridge storage case threadably receives the liquid cartridge in a manner which automatically supplies liquid from the cartridge to the dispensing gun. The cartridge storage case also operatively connects to a pressure source that supplies pressurized air to the inside of the case to force liquid under pressure from the liquid cartridge into the dispensing gun.

The simple and economical design of the cartridge storage case allows liquid cartridges to be easily placed therein, used and subsequently removed, thereby facilitating delivery of pressurized liquid from a liquid cartridge to the dispensing gun. Additionally, by using a plunger valve dispensing gun in combination with this cartridge storage case, increased dispensing accuracy is achieved without any loss of convenience.

To further reduce downtime and to provide a continuous supply of pressurized liquid to the dispensing gun, one or more additional liquid cartridge storage cases may be connected to the dispensing gun in parallel, thereby to eliminate downtime associated with replacing a spent liquid cartridge with a new liquid cartridge.

According to a preferred embodiment of the invention, a liquid cartridge storage case includes threadably connected first and second body sections which form a cylinder. The first or bottom body section includes an internally threaded recessed portion adapted to receive an externally threaded first end of a liquid cartridge. Inside the recessed portion, the bottom section has a protrusion which extends upwardly, and the protrusion has an angled surface. An internal passage extends along the protrusion, through the bottom section and terminates at an outlet on the external surface of the bottom section. Upon threaded connection of a liquid cartridge to the bottom section, the angled surface of the protrusion pierces a bottom membrane of the liquid cartridge, thereby permitting the flow of liquid from the cartridge through the passage to a radial inlet passage of the dispensing gun, which is mounted in fluid communication therewith. A one-way valve is located along the passage, within the body section, to prevent reverse flow back through the passage.

The second or top body section of the cylindrical case includes an opening adapted receive a tube through which pressurized air is supplied from a pressurized air source. The pressurized air supplied to the storage case acts upon a movable end wall at a second end of the liquid cartridge, opposite the first end, thereby moving the end wall of the liquid cartridge toward the hub at the first end and forcing liquid from the cartridge under pressure to the dispensing gun.

Thus, the cylindrical cartridge storage case of this invention provides for easy insertion, use and removal of a liquid filled cartridge, while the dispensing gun associated therewith provides accuracy in dispensing the contents of the liquid cartridge. Because of the simplicity in the design of the cartridge storage case, minimal time is spent preparing to dispense the contents of the liquid filled cartridge.

Additionally, to further reduce downtime, an additional liquid cartridge storage case may be connected to the dispensing gun in parallel to provide continuous dispensing via use of one of the liquid filled cartridges in one storage case during removal of a spent cartridge from the other storage case.

These and other features of the invention will be more readily understood in view of the following detailed description and the drawing.

BRIEF DESCRIPTION OF THE DRAWING

The FIGURE is a cross sectional schematic of a liquid cartridge storage case in combination with a liquid dispenser in accordance with a preferred embodiment of the invention.

DETAILED DESCRIPTION OF THE PREFERRED EMBODIMENT

The FIGURE shows an apparatus for liquid dispensing 10 which includes a liquid cartridge storage case 12 in combination with a liquid dispenser or gun 14 in accordance with a preferred embodiment of the invention. The liquid dispenser 14 includes an electrical controller 16 which controls operation of a solenoid 18 to intermittently raise and lower a plunger valve 20 to open and close, respectively, a passageway 22 through the dispenser 14. The passageway 22 terminates in a nozzle 24, and the FIGURE shows a liquid drop 26 as it is dispensed from nozzle 24 upon raising of the plunger valve 20.

The liquid cartridge storage case 12 is adapted to receive and hold a commercially available liquid cartridge, designated by reference numeral 28. The storage case 12 includes a first lower body section 30 and a second upper body section 32 threadably connected thereto. The liquid cartridge 28 includes an externally threaded lower hub 34 which threadably connects to a complementarily internally threaded, recessed portion 33 of the lower body section 30, thereby connecting the case 12 and cartridge 28 along a common longitudial axis. An outer portion of the bottom of the liquid cartridge 28 is supported within lower body section 30 by an O-ring 35.

When a liquid cartridge 28 is threadably secured to lower body section 30, a bottom membrane 36 of the cartridge 28 is pierced by an angled upper edge 37 of a protrusion 38 which extends upwardly from lower body 30, within recessed portion 33. A passage 40 extends through the protrusion 38 and downwardly through lower body section 30, and the passage 40 makes a right angle turn and extends to the outside of lower body section 30 to connect with a radial passage 42 in the liquid dispenser 14. A one way valve 44 is housed within lower body section 30, along passage 40, to prevent back flow of liquid along passage 40.

A tube 46 threadably connects to a top end of the upper body section 32 of the storage case 12. This tube 46 is in fluid communication with the inside of the storage case 12 via an opening 48 in upper body section 32. Pressurized air is supplied to tube 46 via a pressurized gas tank 50. Gas flow along tube 46 is controlled by a regulator 52 and a solenoid valve 54, operation of which is controlled by an electrical controller 56. The pressurized air supplied to the inside of storage case 12 through opening 48 causes a movable top end 58 of the liquid cartridge 28 to move downwardly, as shown by directional arrows 60, thereby forcing liquid from the cartridge 28 and through passage 40, past valve 44 and into passageway 22 of the liquid dispenser 14, whereupon the liquid is dispensed in accordance with operation of the plunger valve 20.

Use of this liquid cartridge storage case 12 in combination with the liquid dispenser 14 enables liquid to be dispensed from commercially available liquid cartridges 28 with the accuracy and control provided by a plunger-type dispensing gun 14. Additionally, the case 12 provides simple insertion, use and removal of a liquid cartridge 28, thereby reducing set up and downtime.

According to another aspect of the invention, one or more additional liquid cartridge storage cases may be connected to the dispenser 14 to further eliminate downtime associated with substituting a new cartridge 28 for a spent cartridge 28. Accordingly, the FIGURE shows, in phantom, an additional liquid cartridge storage case **12*a* and an additional liquid cartridge 28*a*, both with structural components designated by reference numerals that end in "a" but which otherwise correspond to structural components bearing the same reference numerals without the "a". If desired, additional cases may also be connected to gun 14** in parallel.

According to this embodiment, when cartridge 28 is replaced, by unthreading upper body section 32 from lower body section 30, removing cartridge 28 and replacing it with a new cartridge, and then threading upper body 32 into lower body 30 again, controller 56 operates solenoid valve 54 to divert pressurized air from case 12 to case **12*a*. In this way material is dispensed from cartridge 28*a*, while cartridge 28 is being replaced so that material can continue to be dispensed through nozzle 24** with no downtime.

In sum, the invention provides a simple and economic structure for positively controlling liquid dispensing from a commercially available liquid cartridge 28, with reduced downtime during replacement of spent cartridges 28.

While a preferred embodiment of the invention has been shown and described, it is to be understood that modifications may be made to the preferred embodiment without departing from the scope of the invention. Accordingly, applicant wishes to be bound only by the claims appended hereto:

I claim:

1. An apparatus for dispensing liquid from a commercially available liquid cartridge comprising:

a cartridge storage case adapted to receive a liquid cartridge, the case having a first body section with a portion adapted to engage the cartridge;

a second body section connected to the first body section, the second body section including an opening for supplying pressurized air to the inside of the case;

a protrusion extending upwardly from the first body section of the case and having a passage therethrough, the protrusion adapted to break a membrane of the liquid cartridge upon mounting of the cartridge to the first body section, thereby to allow fluid from the cartridge to flow into the passage;

the passage terminating at an outlet at an outer surface of the first body section and adapted to be placed in fluid communication with an inlet of a liquid dispenser; and a one-way valve within the first body section, along the passage, between the protrusion and the outlet, thereby to prevent back flow of liquid along the passage.

2. A liquid dispensing apparatus comprising:

a dispensing gun having a central passageway therethrough and a nozzle outlet at a first end of the passageway;

a plunger valve extending through the passageway from a second end thereof, the plunger valve being axially movable to open and close the nozzle outlet;

means for axially moving the plunger valve, the moving means located at a second end of the passageway opposite the nozzle outlet;

the gun having an inlet extending from the passageway to an outer surface of the gun;

a cartridge storage case, the cartridge storage case having an internal passage in fluid communication with the inlet;

a first body section of the storage case adapted to receive a liquid cartridge;

a protrusion extending from the first body section, the internal passage extending through the protrusion, the protrusion adapted to pierce a membrane of the liquid cartridge upon connection of the cartridge to the first body section, thereby allowing liquid from the cartridge to flow into the internal passage; and means for pressurizing the inside of the storage case to force liquid from the liquid cartridge to the gun.

3. The liquid dispensing apparatus of claim 2 wherein the first body section includes an internally threaded recessed portion which is adapted to threadably connect to an externally threaded hub of the liquid cartridge, the protrusion located inside of the recessed portion and having an angled upper edge to facilitate piercing the fluid cartridge membrane upon threaded securement of the liquid cartridge to the storage case.

4. The liquid dispensing apparatus of claim 2 wherein the storage case further comprises a second body section connected to the first body section, the second body section having an opening operatively associated with the pressurizing means.

5. The liquid dispensing apparatus of claim 2 and further comprising:

at least one additional cylindrical cartridge storage case connected to the dispensing gun in parallel, thereby to permit a continuous supply of pressurized liquid to the gun during removal of a spent cartridge from one of the cartridge storage cases.

6. The liquid dispensing apparatus of claim 2 wherein the cartridge storage case is attached to the gun.

* * * * *

UNITED STATES PATENT AND TRADEMARK OFFICE

CERTIFICATE OF CORRECTION

PATENT NO. : 5,435,462

DATED : July 25, 1995

INVENTOR(S) : Hideyo Fujii

It is certified that error appears in the above-indentified patent and that said Letters Patent is hereby corrected as shown below:

Title page, and column 1, line 2,
Title [54], Line 2, "DIPENSER" should read --DISPENSER--.

Column 2, Line 25, "adapted receive" should read --adapted to receive--.

Signed and Sealed this

Thirty-first Day of October 1995

Bruce Lehman

*Attest:*

BRUCE LEHMAN

*Attesting Officer*

*Commissioner of Patents and Trademarks*